US007736470B2

(12) United States Patent
Chen et al.

(10) Patent No.: US 7,736,470 B2
(45) Date of Patent: Jun. 15, 2010

(54) COKER FEED METHOD AND APPARATUS

(75) Inventors: Te-Hung Chen, Vienna, VA (US); Christopher P. Eppig, Vienna, VA (US); Timothy M. Healy, Centreville, VA (US); Scott F. Massenzio, Houston, TX (US); Robert W. Mosley, Beaumont, TX (US); Rutton D. Patel, Arlington, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 554 days.

(21) Appl. No.: 11/716,634

(22) Filed: Mar. 12, 2007

(65) Prior Publication Data

US 2008/0179165 A1 Jul. 31, 2008

Related U.S. Application Data

(60) Provisional application No. 60/897,242, filed on Jan. 25, 2007.

(51) Int. Cl.
*C10B 57/04* (2006.01)

(52) U.S. Cl. ..... 201/25; 201/28; 208/131; 202/239

(58) Field of Classification Search ..... 201/25, 201/28; 202/239; 208/131; 196/155
See application file for complete search history.

(56) References Cited

U.S. PATENT DOCUMENTS 5,116,022 A 5/1992 Genreith et al.
5,927,684 A 7/1999 Marx et al.
6,264,829 B1 7/2001 Antalffy et al.
6,565,714 B2 5/2003 Lah
6,660,131 B2 12/2003 Lah
6,843,889 B2 1/2005 Lah et al.
6,964,727 B2 11/2005 Lah
6,989,031 B2 1/2006 Michelson
7,033,460 B2 4/2006 Lah et al.
7,115,190 B2 * 10/2006 Lah ..... 201/25
7,393,435 B2 * 7/2008 De Melo Guerra ..... 202/239
7,438,786 B2 * 10/2008 Malsbury ..... 201/28
2004/0200715 A1 10/2004 Lah
2004/0251121 A1 12/2004 Bosi et al.
2005/0269197 A1 12/2005 Beala et al.
2005/0269247 A1 12/2005 Sparks et al.

OTHER PUBLICATIONS

N. A. Weil and F. S. Rapasky, "Experience with Vessels of Delayed Coking Units", Proceedings of the American Petroleum Institute, (1958), pp. 214-232, Section III Refining.

* cited by examiner

*Primary Examiner*—N. Bhat
(74) *Attorney, Agent, or Firm*—Malcolm D. Keen; Glenn T. Barrett

(57) ABSTRACT

Described herein are methods and mechanisms for laterally dispensing fluid to a coke drum in a predictable and maintainable manner that alleviates thermal stress. In one embodiment, the methods and mechanisms utilize a split piping system to dispense fluid through two or more inlets into a spool that is connected to a coke drum and a coke drum bottom deheader valve. A combination of block valves and clean out ports provides a more effective means to clean the lines and allows fluid to be laterally dispensed in a controllable and predictable manner. The fluid is preferably introduced to the spool in opposing directions toward a central vertical axis of the spool at equal but opposing angles ranging from minus thirty (−30) to thirty (30) degrees relative to a horizontal line laterally bisecting the spool. Alternatively, however, fluid can be introduced to the spool tangentially.

16 Claims, 4 Drawing Sheets

COKER FEED METHOD AND APPARATUS

1.0 CROSS REFERENCE TO RELATED APPLICATION

This invention relates and claims priority to U.S. Provisional Patent Application No. 60/897,242, filed on Jan. 25, 2007, entitled "Coker Feed Method And Apparatus".

2.0 BACKGROUND OF THE INVENTION 2.1 Field

The field of the invention is delayed coking. More particularly, the field of the invention is methods and mechanisms for dispensing fluid to delayed coke drums.

2.2 Description of Related Art

In delayed coking, heavy distillation fractions ("resid" or "residuum") is typically heated rapidly in a fired heater or tubular furnace to create a mixture of hot liquid and vapor which is then fed to a large steel vessel commonly known as a coke drum. The coke drum is maintained under conditions in which coking occurs (e.g., greater than about 400° C. under super-atmospheric pressures). Delayed coke drums are typically cylindrical vessels with a cone at the bottom; that range in diameter anywhere from about 15 to 30 feet. The height of a delayed coke drum is typically two to five times the diameter.

During the delayed coking process, the heated resid undergoes high temperature decomposition to produce more valuable liquid and gaseous products and solid or semi-solid coke residue. The volatile components are removed overhead and pass on to a fractionator. The solid or semi-solid coke left behind accumulates in the drum. When the coke reaches a certain level, a switch valve is moved to redirect the resid to an empty "sister" drum. The hydrocarbon vapors in the full drum, now off line, are then purged with steam and the drum is quenched with steam and water to lower the temperature to less than about 100° C.—after which the water is drained. When the cooling and draining steps are complete, the top and bottom heads of the drum are opened and the coke is removed by drilling and/or cutting. For example, high velocity water jets may be lowered in through the top of the drum.

Typically, each end of a delayed coking drum is capped with a bolted on steel plate called a "head." The process of removing the top and bottom heads of a coke drum is called "unheading" or "deheading." There are several conventional methods for opening the heads of a coke drum. One method is to completely remove the bottom head from the vessel and, optionally, carry it away on a cart. Another method is to swing the bottom head out of the way, as on a hinge or pivot, while the head remains coupled to the vessel. (See e.g. U.S. Pat. No. 6,264,829.) Manually removing the heads, especially the bottom heads, is dangerous work and has resulted in serious injuries and fatalities. Operators face significant risk of injury from exposure to steam, hot water, coke fallout, fire, etc. To help alleviate this risk, the industry has developed semi-automatic or fully automatic systems for the bottom unheading.

From the late 1930s through the 1950s, heated resid was predominately fed to delayed coke drums through a single horizontal side-inlet in a side wall near the bottom of the drum. There are several problems with this design, as illustrated in N. A. Weil and F. S. Rapasky, "*Experience with Vessels of Delayed Coking Units*," Proceedings of the American Petroleum Institute, Section III Refining, pp. 214-232 (1958). Basically, when the heated resid enters the coke drum, it shoots across the drum against the wall opposite the inlet. Thus, the wall opposite the inlet is subjected to higher heat than the remainder of the drum. The thermal shock caused by this non-uniform heat distribution expresses itself in a number of ways, including: recurrent plastic deformation of the coke drum bottom and eventual ovalization; leaks in nearby gasketed joints; metal fatigue; and cracks in the drum.

From the late 1950s to the early 2000s, with some exceptions, the side inlet feed design was replaced with a single vertical bottom-inlet design. Relative to the single side-inlet design, this configuration reduced the non-uniform temperature distribution and concomitant leak problems. Typically, the bottom feed inlet is through the center of the bottom head and the feed line is disconnected before the bottom head is removed.

Over a many years, actuated severe service valves have been suggested in the industry by a number of vendors as a safer and more time efficient alternative to the use of bottom heads on delayed coking drums. Since about 2001, suitable valves for this purpose have been disclosed by, among others, Zimmermann and Jansen GmbH, Curtiss-Wright Flow Corporation and Velan Inc. (See e.g., Zimmermann and Jansen GmbH U.S. Pat. Nos. 5,116,022 and 5,927,684, Curtiss-Wright Flow Control Corporation U.S. Pat. Nos. 6,656,5714, 6,666,0131, 6,843,889, 6,964,727, 6,989,031 and 7,033,460 and Velan Inc. U.S. Patent Application No. 2005/0269197). However, if one replaces a coke drum bottom head with a severe service valve, the concurrent use of a vertical bottom feed-inlet becomes much more problematic and, in some cases, impossible. To be repetitively and continuously operable through numerous coking/decoking cycles without removal, this type of valve closure requires a lateral feed system that is located above the valve apparatus. As a result, the industry is moving back to the use of a single horizontal side-inlet feed nozzle despite the associated thermal stress problems. This is illustrated, for example, in U.S. Patent Application No. 2004/0251121.

Two published patent applications, namely, US Patent Application No. 2004/0200715 and US Patent Application No. 2004/0251121, have attempted to address the stress induced leakage problems encountered in coke drums when a valve is used as a bottom head in combination with a single side feed inlet. These proposed solutions treat the symptom rather than the disease by focusing on valve insulation and seal design to increase thermal stress resistance rather than the uneven feed distribution that causes the thermal stress.

U.S. Pat. No. 7,115,190 ("the '190 patent") describes "a tangential injection system for use within a delayed coking system . . . . The tangential injection system comprises a spool, [and] a tangential dispenser, . . . wherein the tangential dispenser comprises a delivery main surrounding the perimeter of the spool that functions to deliver a residual byproduct . . . to a plurality of feed lines positioned . . . at distances around the delivery main for the purpose of providing tangential dispensing of the residual byproduct into the vessel, thus effectuating even thermal distribution throughout the vessel." The complexity of the tangential injection system described in the '190 patent is self-evident from the patent itself. "[F]riction forces tend to create a reduction in the velocity of the residual material as it travels through [the] curved pipe section . . . . As such, these forces are taken into consideration when designing the size and location of each of [the] feed lines . . . , their respective angles of entry, as well as the respective cross-sectional areas of each feed line and delivery main." See the '190 patent col. 7, lines 46-55. "The relative sizes of the plurality of feed lines may vary so that the volume and/or velocity passing through the lines in [sic] somewhat equalized . . . . " See the '910 patent col. 8 lines 6-8.

The '190 patent also "illustrates . . . [a] prior art dispenser . . . namely a system comprising two opposing, co-axial inlet feeds coupled to a vessel in the form of a coke drum." See the '190 patent col. 4 lines 55-59. The '190 patent then asserts that "[a]lthough the addition of another dispenser or inlet feed helps alleviate some of the problems discussed above . . . namely the lack of uniform heat distribution, the remedial effect or benefit of two opposing inlet feeds on these problems is only minimal. A significant amount of uneven heat distribution and thermal variance still exists within or throughout [the] vessel because of the inability of the inlet feeds . . . to dispense byproduct in a controlled and predictable manner." [Italic emphasis added]. "For example, byproduct from each feed inlet . . . is dispensed into the vessel. If the pressure within each inlet feed are similar, the byproduct from each feed inlet will meet somewhere in the middle and cause the byproduct to be randomly displaced within [the] vessel . . . . On the other hand, in the even [sic; event] that a pressure differential exists between inlet feeds . . . then the byproduct will be even more randomly dispensed and the problems of thermal variance increased." See the '190 patent col. 3 lines 6-22.

There remains a need to provide easier and more effective solutions to the high thermal stress problems caused by the lateral side introduction of heated resid to coke drums in view of the industry's desire to replace coke drum bottom heads with valves.

3.0 BRIEF DESCRIPTION OF THE SEVERAL VIEWS OF THE DRAWINGS

The following drawings are for illustration purposes only and are not intended to limit the scope of the present teachings in any way:

4.0 SUMMARY OF THE INVENTION

Figure 1:
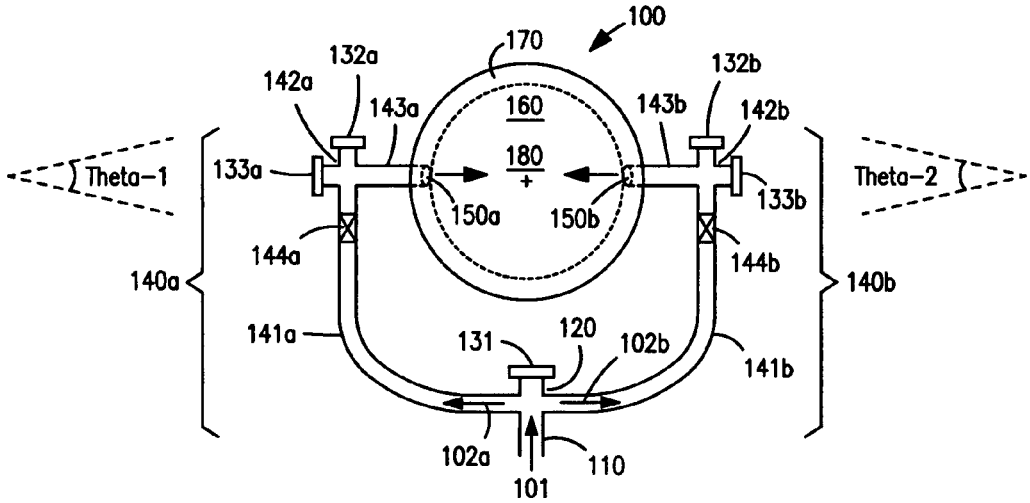
FIG. 1 is an overhead perspective of a horizontal cross-section of one embodiment of the dispensing system described herein.

Described herein are methods and mechanisms for laterally dispensing fluid to a coke drum in a predictable and maintainable manner that reduces drum/vessel thermal stress. The methods and mechanisms utilize a split piping system to dispense fluid through two or more inlets into a spool that is connected to a coke drum. The use of a combination of block valves and clean out ports provides an effective means to clean the lines and, thereby, allows the fluid to be laterally dispensed in a more controllable and predictable manner. The fluid may be introduced to the spool in opposing directions toward a central vertical axis of the spool at any angle between minus 30 degrees and 30 degrees relative to horizontal or, less preferably, tangential to the sides of the spool. The combination of opposing feed entry and angled feed entry using the split piping system is especially advantageous in reducing the total thermal stress connected with side introduction of heated fluid to the spool. By using the embodiments described herein, refineries can avail themselves of the safety and cycle time benefits provided by coke drum bottom deheader valves that require side fluid entry without incurring significant thermal stress problems in the vessel (e.g., recurrent plastic deformation of the coke drum bottom, leaks in nearby gasketed joints, metal fatigue and cracks in the drum). These and other features of the invention are set forth in more detail below.

5.0 DETAILED DESCRIPTION OF THE INVENTION

5.1 Definitions

Unless expressly defined otherwise, all technical and scientific terms used herein have the meaning commonly understood by those of ordinary skill in the art. The following words and phrases have the following meanings:

"Fluid" means any material composed primarily of liquid and/or gas.

5.2 Detailed Description

Described herein are methods and mechanisms for laterally dispensing fluid to a coke drum in a predictable and maintainable manner that alleviates thermal stress. Depending on the delayed coking process, and where a coke drum is in the delayed coking cycle, the fluid fed to the drum may be resid, water, steam or a solution containing coke morphology affecting additives.

More particularly, in a delayed coker system, resid feed is passed by a coker furnace and then fed to one of a pair, or sometimes a triplet, of coke drums. The coker furnace usually has a number of parallel process fluid passes which are then combined into one effluent transfer line. Switch valves direct the feed from the transfer line to a particular drum. The resid feed that enters the drum is at elevated temperatures and pressures, often between 900 and 935° F. and up to 100 psig, and is comprised of two or more phases. The feed may, for example be comprised of up to about 20 wt. % vapor phase, and up to 80 wt. % of one or more liquid phases. There may also be present a small amount of solid coke. Superficial velocities are high, often on order of 100 ft/sec.

In addition, during particular cycles of the delayed coking process, water and steam may be fed to the coke drum. For example, steam may be injected into the coke drum to enhance the stripping of vapor products overhead. During steam stripping, steam is flowed upwardly through the bed of coke in the coke drum and recovered overhead through a vapor exit line. In further example, at the completion of each fill cycle, the coke drum may be cooled by steaming and then flooding the coke drum with water, thereby producing a coke/water mixture. This process is described, for example, in U.S. Patent Application No. 2005/0269247, the entirety of which is hereby incorporated by reference. Furthermore, steam may be introduced to further "aerate" and dislodge coke that gets trapped during a decoking operation and, thereby, control the flow rate of coke or a coke/water mixture as it exits the drum.

Finally, a solution of additives may be introduced to the coke drum at various times during the delayed coking cycle to affect the morphology of coke formed in the drum (e.g., the degree to which sponge coke, transition coke and/or shot coke is formed). Suitable additives are set forth, for example, in U.S. Patent Application No. 2005/0269247 which, as stated, is hereby incorporated by reference.

In one embodiment of the invention, a fluid dispensing apparatus is provided for use with a delayed coke drum. The embodiment comprises a number of components. A first component is a spool that has a wall that encloses an interior space. The top surface of the spool is coupled to the bottom surface of a delayed coke drum. The bottom surface of the spool is coupled to the top surface of a coke drum bottom deheader valve. A second component is a main pipe for supplying a primary fluid stream. A third component is a split piping system that comprises an intersection where the primary fluid stream is split into two secondary fluid streams that flow in separate directions along separate legs of branch piping. Each leg of branch piping in the split piping system terminates with an equal number of ports that are, or are connected to, spool inlets that allow fluid to flow into the interior space enclosed by the spool. Each leg of branch piping in the split piping system may comprise one or more pipes, one or more block valves and one or more removably covered cleaning ports.

As stated, the first component is a hollow spool that is coupled to the bottom surface of a delayed coke drum and the top surface of a coke drum bottom deheader valve. The spool encloses an interior space with a wall that has an inside and an outside surface and is typically a hollow cylinder or cone. The spool may be flanged around its upper and lower ends to facilitate attachment. Attachment of the spool to the coke drum may be effected by welding or bolting the flange on the upper surface of the spool to a flange surrounding the bottom surface of a delayed coke drum or by any other means known in the art for attaching a spool to the bottom of a delayed coke drum. Similarly, attachment of the spool to the coke drum bottom deheader valve may be effected by welding or bolting the flange on the bottom surface of the spool to a flange surrounding the upper surface of a coke drum bottom deheader valve or by any other means known in the art for attaching a spool to a coke drum bottom deheader valve. Preferably, the interior space enclosed by the top of the spool aligns smoothly with the interior space enclosed by the bottom of the coke drum. Preferably, the spool is cone shaped to facilitate attachment to the typically smaller diameter of a coke drum bottom deheader valve.

As stated, a second component is a main pipe for supplying a primary fluid stream. This main pipe is located downstream from a switch valve and is the dedicated feed pipe for a particular drum. Depending on where the coke drum is in the delayed coking cycle, the primary fluid stream may be resid, water, steam or a solution containing one or more additives that affect coke morphology.

As stated, a third component is a split piping system. The split piping system comprises an intersection where the primary fluid stream is split into two secondary fluid streams that flow in separate directions along separate legs of branch piping. The intersection (or "feed splitter") may be a tee "T" shaped fitting, or a wye "Y" shaped fitting, or cross "+" shaped fitting with one port blocked. Preferably, this intersection is symmetrical. Preferably, this intersection is a cross shaped fitting with one port reversibly blocked with a flange to serve as a cleaning port.

Each leg of branch piping comprises one or more pipes. In other words, each branch leg may be a continuous branch pipe or may, for instance, be a branch pipe that is connected by a fitting to one or more entry pipes to the spool. Each leg of the branch piping terminates with an equal number of ports that are, or are connected to, spool inlets that allow fluid to flow into the interior space enclosed by the spool.

In one embodiment, the feed splitter and each leg of branch piping is configured so that the mass flow rate of the secondary fluid streams is within 50% of one another. In a preferred embodiment, the feed splitter and each leg of branch piping is configured so that the mass flow rate of the secondary streams are within 25% of one another. Ideally, the secondary fluid streams are substantially equal in flow mass.

In one embodiment, the feed splitter and each leg of branch piping is configured so that the proportion of liquid to vapor in the secondary fluid streams is within 50% of one another. In a more preferred embodiment, the feed splitter and each leg of branch piping is configured so that the proportions of liquid to vapor in the secondary fluid streams are within 25% of one another. Ideally, proportion of liquid to vapor in the secondary fluid streams is substantially equal to one another.

Ideally, the flow velocity in each leg of the split should be also be equal to, or greater than, the flow velocity of the primary fluid (e.g., the combined furnace effluent) in the main pipe line prior to the split.

Maintaining substantially equal mass flow rates and liquid/vapor proportions between the secondary fluid streams, at flow velocities that are equal to, or greater than, the flow velocity of the primary fluid stream, is easily accomplished by maintaining symmetry between the two legs of branch piping. More specifically, each leg of branch piping is symmetrical to the other in diameter and configuration relative to at least one axis bisecting the splitter and the sum of the diameters of each leg of branch piping is less than or equal to (and preferably equal to) the diameter of the main pipe.

As stated, each leg of branch piping terminates with an equal number of ports that are, or are connected to, spool inlets that allow fluid to flow into the interior space enclosed by the spool. In other words, an outlet of each leg of branch piping can terminate at an aperture in the wall of the spool or, alternatively, each leg of branch piping can run through an aperture in the spool. In the later case, the outlet of each leg of branch piping is a spool inlet and there must be a fluid tight fit between the piping and the spool capable of withstanding severe service conditions.

Preferably, each leg of branch piping runs through an aperture in the spool so that it extends a small degree into the interior space. Alternatively, a protective structure, termed an "eyebrow" herein, extends above or around the spool inlet and penetrates a small degree into the interior space of the spool. Both embodiments hinder coke from flowing back into the inlet during drum decoking operations. The extended pipe, or eyebrow, as the case may be, typically extends past the interior wall of the spool into the spool interior a distance that, when measured horizontally, is no greater than five percent (5%) of the spool diameter at the same level.

The number of spool inlets is not limited as long as there are an equal number of spool inlets for each leg of branch piping. However, simpler designs tend to limit thermal stress more efficiently. Therefore, in a preferred embodiment, each leg of branch piping terminates with only one port that is, or is connected to, a spool inlet that allows fluid to flow into the interior space enclosed by the spool. In this instance, since there are only two legs of branch piping, the number of spool inlets is two. However, other configurations are also envisioned, most notably where each leg of branch piping has two ports that are, or are connected to, a spool inlet.

The spool inlets should be spaced symmetrically around the interior wall of the spool and on the same lateral plane. Thus, if there are two spool inlets, they should be located approximately 180 degrees apart along an inside surface of the spool wall. Alternatively, if there are four spool inlets, they should be spaced so that each spool inlet forms one corner of a parallelogram, such as a rhombus, square or rectangle, on a lateral plane.

Preferably, the secondary fluid streams are dispensed into the interior of the spool in opposing directions toward the center of the spool. By uniformly splitting the feed, and directing the feed into the coker bottom inlet plenum in opposing directions (e.g., via two nozzles opposed 180 degrees apart), the flows impinge one another and do not impinge forcibly on the opposing wall. The result is a more uniform temperature distribution in the bottom plenum of the coke drum relative to a single feed inlet. Contrary to some teachings, such an arrangement is predictable and controllable if, for example, the feed lines are adequately cleaned.

Alternatively, but less preferably, the fluid streams may be dispensed into the interior of the spool tangential to the inside surface of the spool wall. By uniformly splitting the feed, and directing the feed into the coker bottom inlet plenum via two nozzles arranged to create a tangential flow, a circular flow pattern is established, and this can also result in a more uniform temperature distribution in the bottom plenum of the coke drum relative to a single feed inlet.

In either case, substantial reduction in thermal stress is achieved relative to a single horizontal feed inlet. This translates into a reduced incidence of leaking flanges, and a longer time between cracks in the vessel walls.

In one embodiment, each leg of branch piping also comprises one or more block valves (a.k.a. on-off valves or isolation valves) that are positioned along the length of the leg of branch piping. Each block valve serves to cut the flow of fluid from the splitter to the spool inlets on and off. Preferably, each leg of branch piping comprises one block valve since only one block valve is necessary to cut the flow of fluid on and off. The block valves may be operated manually or actuated automatically. Preferably, the block valves are automated so that their operation may be interlocked and sequenced with other valves on the coker unit. The block valves may be selected from any valve used to start or stop fluid flow. Preferably, the block valves are selected from ball valves, gate valves, knife valves and wedge valves.

In one embodiment, each leg of branch piping also comprises one or more removably covered cleaning ports. Preferably, the removable cover on each cleaning port is a blind flange that can be opened and closed (e.g., a blind flange that is bolted, screwed or otherwise reversibly attached to the port). Ideally, there is one cleaning port aligned with each pipe component of each leg of branch piping and, also, one cleaning port aligned with the main pipe leading to the splitter. These ports can be easily provided, for example, by using a cross fitting. If a cross fitting is used, the clean out ports are those ports on the fitting that are not connected to a pipe.

The use of a combination of one or more block valves and one or more cleaning ports is especially advantageous as it allows one to easily blow out each leg of the branch piping. A steam out procedure can be performed on each individual line after the coke drum fill cycle to ensure that the leg is properly freed of resid. This can be done by opening a cleaning port in a first leg of the branch piping while the block valve in the leg remains open, closing the block valve in the other leg of the branch piping, purging the first branch leg with water and/or steam and then reopening the closed block valve. The process is then repeated for the other leg of branch piping. This steam blow out procedure, using a combination of block valves and clean out ports, assists in keeping the branch piping free of coke buildup which, in turn, insures a more predictable and controllable flow and distribution of fluid to the spool.

The use of clean out ports that are aligned with each pipe segment of the branch piping also allows each pipe segment to be directly treated by hydroblasting and/or other conventional cleaning methods. Over time, coke deposits can build up within the internal components of the dispensing apparatus, even if the lines are blown out with steam on a regular basis. If the process efficiency becomes too low, the apparatus is opened for internal cleaning. One approach to internal cleaning is the insertion of a pipe into the lines that conveys high-pressure water against the internal walls. Alternatively, the internal walls can be scraped. Either way, the efficiency of the cleaning process is increased if there are clean out ports that directly align with each pipe segment. This clean out procedure, using aligned clean out ports, assists in keeping the branch piping free of coke buildup which, in turn, insures a more predictable and controllable flow and distribution of fluid to the spool.

FIG. 1 illustrates a preferred embodiment of the invention. FIG. 1 is a horizontal cross-section (a "top view) of a dispensing system 100 for the coke drum.

In FIG. 1, a primary fluid stream 101, such as a combined coker effluent, travels through a main pipe 110 downstream from a coker feed switch valve (not shown). The primary fluid stream 101 enters cross 120. Cross 120 has one cleaning port (not numbered), aligned with the main pipe 110 and located opposite the port connected to main pipe 110. The cleaning port is removably blocked with a blind flange 131. Cross 120 splits primary fluid stream 101 into two secondary fluid streams (102*a* and 102*b*) that each, independently, exit cross 120 through opposing outlet ports (not numbered) into two symmetrical legs of branch piping (140*a* and 140*b*). Each leg of branch piping comprises a branch pipe (141*a* and 142*b*), a cross (142*a* and 142*b*) and an entry pipe (143*a* and 143*b*). The two symmetrical legs of branch piping (140*a* and 140*b*) carry the secondary fluid streams (102*a* and 102*b*) in separate directions.

In FIG. 1, branch pipe 141*a* in the first leg of branch piping 140*a* carries secondary fluid stream 102*a* to another cross 142*a* where it is diverted into an entry pipe 143*a*. Branch pipe 141*a* contains within its length a block valve 144*a* that turns the flow of fluid on and off. Cross 142*a* in the first leg of branch piping 140*a* has a first cleaning port (not numbered) that is aligned with branch pipe 141*a* and located opposite the port (not numbered) connected to branch pipe 141*a*. Said first cleaning port is removably blocked with a blind flange 132*a*. Cross 142*a* also has a second cleaning port (not numbered) that is aligned with an entry pipe 143*a* and located opposite the port (not numbered) connected to entry pipe 143*a*. Said second cleaning port is removably blocked with a blind flange 133*a*. Entry pipe 143*a* terminates with one outlet (not numbered) that is, or is connected to, a spool inlet 150*a* that allows fluid to flow into the interior space 160 enclosed by the wall of a spool 170.

In FIG. 1, branch pipe 141*b* in the second leg of branch piping 140*b* carries secondary fluid stream 102*b* to another cross 142*b* where it is diverted into an entry pipe 143*b*. Branch pipe 141*b* contains within its length a block valve 144*b* that turns the flow of fluid on and off. Cross 142*b* in the second leg of branch piping 140*b* has a first cleaning port (not numbered) that is aligned with branch pipe 141*b* and located opposite the port (not numbered) connected to branch pipe 141*b*. Said first cleaning port is removably blocked with a blind flange 132*b*. Cross 142*b* also has a second cleaning port (not numbered) that is aligned with an entry pipe 143*b* and located opposite the port (not numbered) connected to entry pipe 143*b*. Said second cleaning port is removably blocked with a blind flange 133*b*. Entry pipe 143*b* terminates with one outlet (not numbered) that is, or is connected to, a spool inlet 150*b* that allows fluid to flow into the interior space 160 enclosed by the wall of a hollow spool 170.

In FIG. 1, the spool (170) is a cylinder or cone. Therefore, the interior surface (not numbered) of the spool (170) is circular. Spool inlets (150*a* and 150*b*) are located on the same horizontal plane within the spool but positioned 180 degrees apart. In FIG. 1, the flow of secondary streams (102*a* and 102*b*) through the entry pipes (143*a* and 143*b*) and out the spool inlets (150*a* and 150*b*) is normal to the spool. In other words, Theta-1 and Theta-2 in FIG. 1 represent the angle of the axes of the entry pipes (143*a* and 143*b*) relative to a cone bisecting line (shown as a horizontal line). Theta-1 and Theta-2 are 0 degrees. Accordingly, the secondary streams (102*a* and 102*b*) flow in opposite directions toward one another and toward a central point 180 in the interior space (160) of the spool (170).

Accordingly, as described in FIG. 1, in one embodiment the split piping system comprises the following components:

(i) two symmetrical branch pipes, each located downstream from the main pipe, each having an inlet port and an outlet port, each equal in diameter to one another but smaller in diameter to the main pipe, and each having a block valve therein, (ii) a main pipe fitting that comprises at least four ports where a first port is an inlet port connected to an outlet port of the main pipe, a second port is an outlet port connected to the inlet port of one branch pipe, a third port is an outlet port connected to the inlet port of the other branch pipe a fourth port is a cleaning port that is removably covered and aligned opposite the first port, (iii) two entry pipes, each located downstream from a different branch pipe and each having an inlet port and an outlet port, wherein the outlet port of each entry pipe is, or is connected to, an outlet into the interior space of the spool, and (iv) two branch pipe fittings each comprising at least four connection ports where a first port is an inlet port connected to the outlet port of a branch pipe, a second port is an outlet port connected to the inlet port of an entry pipe, a third port is a cleaning port that is removably covered and aligned opposite the first port; and the fourth port is a cleaning port that is removably covered and aligned opposite the second port.

The flow of secondary streams can be angled into the drum in both the horizontal and vertical planes. In other words, if Theta-1 and Theta-2 in FIG. 1 represent the angles that the entry pipes 143*a* and 143*b* span relative to a cone bisecting line (a horizontal line in the figure), then the angle of the entry pipe can be changed from zero to less than ninety (90) degrees in any direction.

It is preferable, for example, to angle the flow of the secondary streams vertically whenever the streams are dispensed toward the center of the drum in opposing directions as a means of reducing thermal stress. Preferably, the secondary fluid streams are dispensed at equal but opposing angles that can range from minus thirty (−30) to thirty (30) degrees relative to a horizontal line that laterally bisects the spool. More preferably, the angle is greater than zero (0) but not greater than thirty (30) degrees above horizontal and, ideally, greater than five (5) degrees but not greater than twenty (20) degrees above horizontal. By dispensing the secondary fluid streams toward the center of the spool at a equal but opposing angles (and preferably angled upward toward the attached drum), the thermal stresses imparted by side fluid entry is reduced even more.

Figure 2:
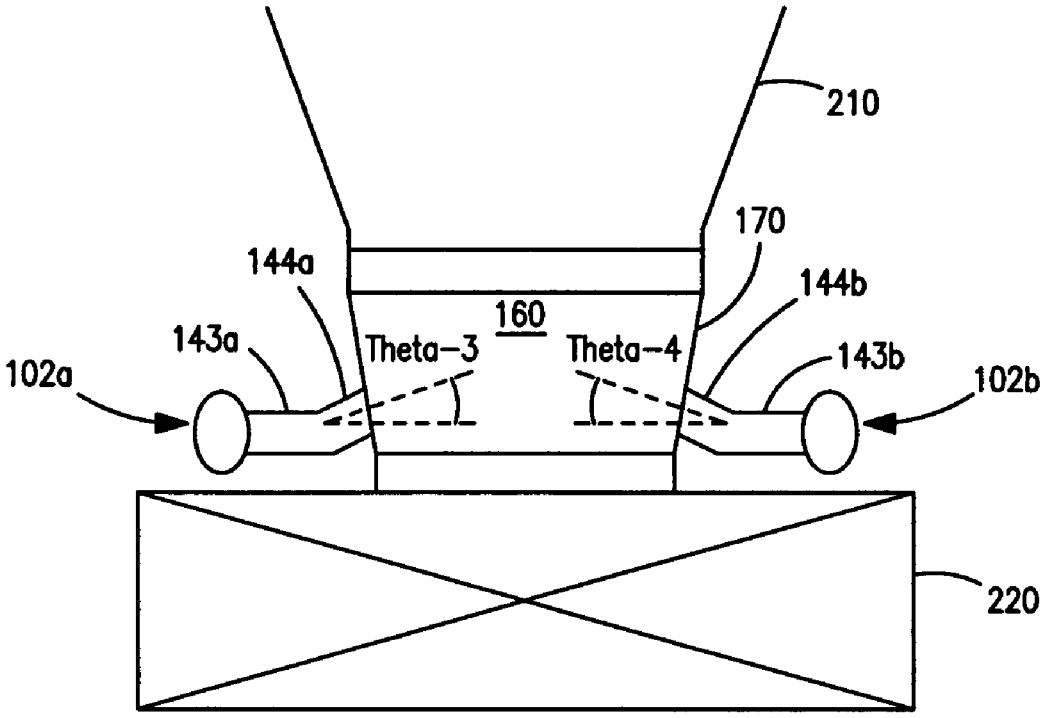
FIG. 2 is a side perspective of a lateral cross-section of one embodiment of the dispensing system described herein.

FIG. 2 illustrates this embodiment. FIG. 2 is lateral perspective ("side view) of a spool 170 attached at its upper end to the bottom of a coke drum 210 and at its lower end to the top of a coke drum bottom deheader valve 220. In FIG. 2, side streams 102*a* and 102*b* enter the interior space 160 of a hollow spool 170 laterally through entry pipes 143*a* and 143*b* which form the end portion of a dispensing system (the preceding portions of which are not shown). An end portion 144*a* of entry pipe 143*a* angles upward from horizontal into spool 170 at angle Theta-3. An end portion 144*b* of entry pipe 143*a* angles upward from horizontal into spool 170 at angle Theta-4. Angle Theta-3 equals angle Theta-4 and is not greater than thirty (30) degrees relative to horizontal. As a result, secondary fluid streams (102*a* and 102*b*) are dispensed in opposing directions toward the center (not numbered) of the spool 170 at an upward angle that is greater than zero but not greater than thirty degrees above horizontal.

Alternatively, but less preferably, the fluid streams may be dispensed into the interior of the spool tangential to the inside surface of the spool wall. This embodiment is illustrated in FIG. 3 which is a horizontal cross-section (a "top view) of a spool 170.

Figure 3:
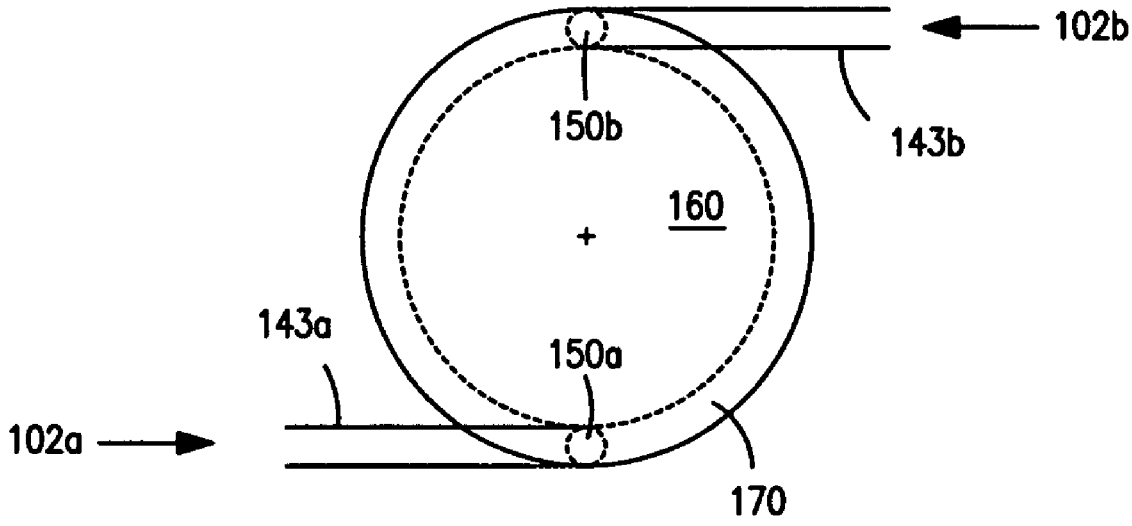
FIG. 3 illustrates the tangential introduction of fluid to a spool.

In FIG. 3, side streams 102*a* and 102*b* enter the interior space 160 of a hollow spool 170 laterally through entry pipes (143*a* and 143*b*) which form the end portion of a dispensing system (the preceding portions of which are not shown). Entry pipe 143*a* is oriented at an angle that is greater less than zero and less than 90 degrees relative to the direction of the interior wall (represented by a dotted line) of the spool 170 at point of spool inlet 150*a*. Entry pipe 143*a* is oriented at an angle that is greater less than zero and less than 90 degrees relative to the direction of the interior wall (represented by a dotted line) of the spool 170 at point of spool inlet 150*b*. Preferably, in this embodiment, the angle of each entry pipe (143*a* and 143*b*) to the relative to its associated spool inlet (150*a* and 150*b*, respectively) is equal.

For the purposes of clarity, the fluid dispensing apparatus of the present invention has been described in context with the coke drum, main pipe and coke drum bottom deheader valve with which it typically interacts. It is anticipated that the top of the spool will be attached to a coke drum, that the bottom of the spool will be attached to a coke drum bottom deheader valve and that split piping system will be attached to a main transport pipe for the coke drum. However, in another embodiment, prior to such attachments, the fluid dispensing apparatus comprises the following components:

(a) a spool that has a wall that encloses an interior space, an upper flanged surface for connection to the bottom of a delayed coke drum and a bottom flanged surface for connection to the top of a coke drum bottom deheader valve; and (b) a split piping system which comprises an intersection that splits a primary fluid stream into two secondary fluid streams that flow in separate directions along separate legs of branch piping, where each leg of branch piping comprises one or more pipes, one or more block valves and one or more removably covered cleaning ports, and where each leg of branch piping terminates with an equal number of ports that are, or are connected to, spool inlets that allow fluid to flow into the interior space enclosed by the spool.

It should also be noted that the dispensing mechanisms of the present invention may also be coupled directly to a coke drum without the use of an intermediate hollow spool. In this embodiment, nothing changes except that the spool and spool inlets are replaced by a coke drum cross section and coke drum inlets. This embodiment is not preferred since it is easier to retrofit existing drums using a spool. Furthermore, spools must generally be employed anyway in order to fit coke drum bottom deheader valves.

As stated, the dispensing mechanisms of the present invention may, and preferably are, utilized in combination with a coke drum bottom deheading valve. Suitable valves have been disclosed by, among others, Zimmermann and Jansen GmbH, Curtiss-Wright Flow Corporation and Velan Inc. (See e.g., Zimmermann and Jansen GmbH U.S. Pat. Nos. 5,116,022 and 5,927,684, Curtiss-Wright Flow Control Corporation U.S. Pat. Nos. 6,565,714; 6,660,131; 6,843,889, 6,964, 727, 6,989,031 and 7,033,460 and Velan Inc. U.S. Patent Application No. 2005/0269197, the entireties of which are hereby incorporated by reference). Suitable valves slide valves, through conduit gate valves, plug valves and ball valves. Preferably, the valve is a slide valve or through conduit gate valve that can be throttled under severe service conditions. The valve is preferably attached at the bottom of the spool by welding or bolting a flange on the upper surface of the valve to a flange surrounding the bottom surface of the spool, or by any other means known in the art for attaching a valve to the bottom of a spool.

Various instrumentation may be added to the inlet lines, inlet nozzles, and the section of the coke drum/spool piece near the inlet nozzles, and this instrumentation along with process controllers may be used to control certain aspects of the coking cycle. For example, the spool optionally contains thermocouples, positioned at various locations around the outside surface of the spool, which feed information to one or more controllers. These controllers can then use the temperature information to, inter alia, control the rate at which quench water is added during a coked drum cool down step.

5.3 EXAMPLES

Example 1

An existing coke drum has a 72" diameter bottom manway, and an 8" diameter feed line which enters the existing bottom head vertically on the center axis of the coke drum. It is desired to employ a nominal 60" diameter Zimmermann & Jansen or DeltaValve coke drum bottom deheader valve on this installation.

A flanged 72"×60" transition cone/spool is fabricated. The cone is fabricated from 1 Chrome ½ Moly steel and has a ⅛" thick 410 stainless steel interior overlay. Two 6" 9-chrome nozzles are located 180 degrees apart on the cone, and are as low to the bottom of the cone as allowed by mechanical design code. The angles that the nozzles make, relative to horizontal, are set so that if flow from the nozzle were to impinge on the opposing wall it would not impinge directly on the upper flange. In this instance, the cone is 32" high, has a lower opening with a 60" diameter and an upper opening with a 72" diameter and the nozzle angles are equal and set at 5 degrees above horizontal. Kuckles are used at joint connections where appropriate.

Piping and fittings are constructed to uniformly split the flow. Piping is as symmetrical as possible to allow for equal pressure drops and flow patterns in each leg of the piping. Each leg has an isolation valve.

The inlet piping, cone, and bottom valve are connected to the coke drum.

The delayed coker is operated. At the conclusion of the on-oil cycle, steam is purged through the dual line feed system. At the conclusion of the steam purge, the individual leg isolation valves are cycled so as to first blow steam through one leg, and then the other. This assists with freeing each leg of resid and coke particles.

At the conclusion of the water quench cycled, water is drained either through the feed lines, or out of the coke drum bottom valve. Coke may be cut out of the drum via standard techniques, or flowed out as a coke plus water mixture, as described in U.S. Patent Application No. 2005/0269247.

Thermocouples are tack-welded to the exterior of the cone. Five are welded along an exterior vertical line on what is the "south" of the cone. Five each are also welded on vertical lines on the "east" and "north" exterior at the same heights as those welded on the "south".

Temperature data are obtained from the thermocouples and logged on a data logger versus time for over 50 complete coking cycles. The temperature data are plotted versus time on graphs and the trends for one cycle compared with others, with particular emphasis comparing temperature changes during the first one-half hour after introduction of hot oil, as this is the time with the greatest change in temperature versus time and the time of greatest potential thermal stress in the cone metal wall.

The temperature-versus-time trends are very similar on the "north", "south", and "east" thermocouples for a significant portion of the cycle, especially the oil-in portion of the cycle, indicating that the fluid inside the cone is being distributed evenly enough to create a substantially uniform heat distribution in the cone metal wall.

Temperature-versus-time and location trends are also compared for cycles that are weeks and months apart. The trends are very reproducible over many cycles, proving that the feed is entering into the cone and flowing therein in a very reproducible, controlled, and predictable manner.

Example 2

The system above is equipped with 28 thermocouples strategically located on the feed inlet lines, coke drum cone and coke drum valve. Temperature signals are obtained throughout the coking cycles. The temperature signals are digitized and used as inputs to automatic controllers which control the rate of the quench water so as to optimize throughput and, thereby, minimize stress on the inlet components, drum cone, and bottom valve. The temperature data also provide indices of equipment health.

Example 3

In the system above, steam is added to the inlet piping during the coke drum emptying cycle to help "aerate" the coke plus water mixture exiting from the coke drum and, thereby, help control the flow rate of the coke plus water mixture.

Example 4

A computational fluid dynamics (CFD) model was created to simulate the time-dependent fluid flow within the inlet cone region of the system described in Example 1. The commercial CFD simulation software Fluent v6.2 (Ansys, Inc., Canonsburg, Pa.) was used to solve the time-dependent equations governing mass and momentum conservation based on certain model inputs describing the inlet cone geometry, fluid properties, and flow rates. Once completed, each simulation produces three-dimensional data on pressure, velocity (three components of the velocity vector) and phase volume fractions (for multiphase calculations). Additionally, average and root-mean-square values for all output quantities are calculated to determine the mean flow pattern within the inlet cone and the strength and extent of fluctuating flow structures. All simulation results were visualized based on plots generated by Tecplot 360 visualization software (Amtec Engineering, Bellevue, Wash.).

The geometry used for all simulations consisted of a 60" by 72" diameter cone 32" high. The cone was fed by 6" nominal diameter pipe inlets located 180 degrees apart and pointing upwards 5 degrees above the horizontal. The pipe inlets entered the cone 22" (570 mm) above the plane of the closed slide valve. For the purposes of the simulations, the coke drum diameter above the 72" exit of the cone was held fixed at this diameter and extended approximately 6' above the outlet of the cone region. For CFD analysis, this geometry was divided into 80,000 small volumes upon which the conservation laws were applied. The resulting set of conservation laws was solved using a software-controlled time step to minimize errors inherent in the discrete numerical integration algorithm. In this way, fluctuations at resolved scales would be captured by the CFD technique.

The feed rate and physical properties for the feed were derived from experimental data and correlations at coker inlet temperature and pressure. These conditions were the following.

Figure 4A:
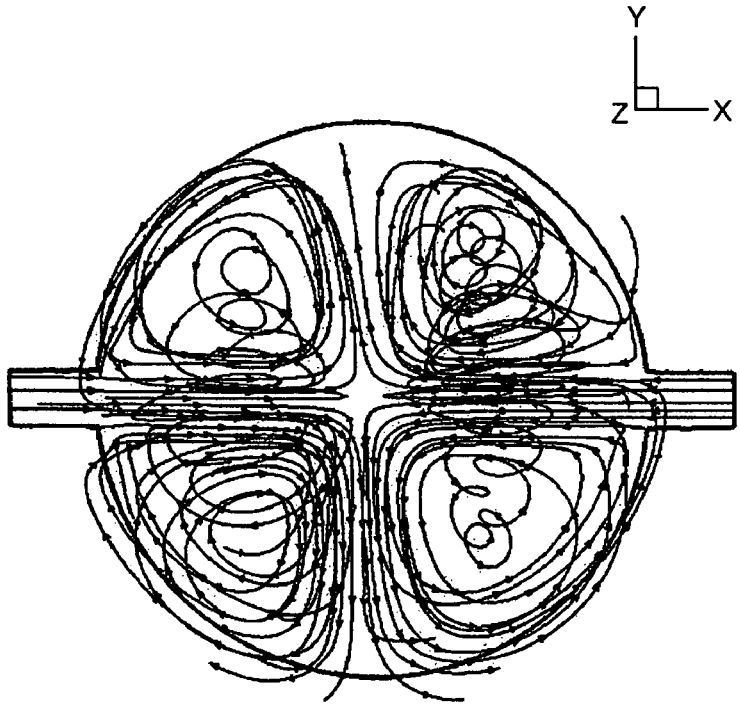
FIG. 4A shows streamtraces calculated from a simulation viewed from the outlet of the simulated coker vessel.
Figure 4B:
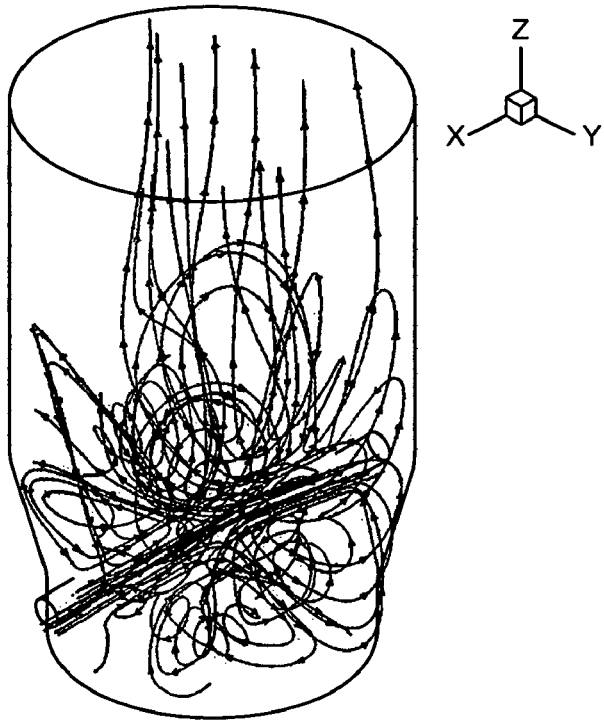
FIG. 4B shows a three-dimensional view of the streamtraces in FIG. 4A from outside of the coker vessel.

Feed rate=48.5 lb/sec
Liquid density=46 lb/ft3
Vapor density=2.9 lb/ft3
Vapor mass fraction=22 mass %
Liquid viscosity=0.9 centipoise
Vapor viscosity=0.008 centipoise FIG. 4A shows streamtraces calculated from the simulation viewed from the outlet of the simulated coker vessel. FIG. 4B shows a three-dimensional view of the streamtraces in FIG. 4A from outside of the vessel. Referring to FIG. 4A and FIG.4B, simulations showed that the mean flow pattern within the cone consisted of direct impingement of the opposing jets followed by outward motion of the fluid away from the impact point in a plane perpendicular to the inlet pipe centerlines. These two lines of action toward and away from the impact point of the opposing jets divided the tower cross section into four quadrants. The outward flow from the impact point was rolled up by contact with the cone walls producing a complex circulation of fluid within the bottom half of the simulated coker vessel. Within each quadrant, a helical flow structure was observed with some circulation of fluid among the quadrants. The compartmentalized flow patterns provide flow circulation against the cone wall and, consequently, fairly uniform heat transfer from the fluid to the metal cone wall. These effects are reproducible across multiple coker cycles.

Analysis of the time-history used to calculate the mean flow patterns discussed above showed that the flow within the cone was unsteady with near-periodic motion of the opposing jets about the centerline of the cone. The amplitude of the periodic motion was low with no direct impingement of either jet on the tower walls. By analyzing the intensity of the pressure and velocity fluctuations about their mean values, the fluctuating region of the flow field can be readily identified. Based on this analysis, the volume of the cone where the kinetic energy of the fluctuations caused by the periodic motion of the impinging jets was greater than 0.1% of the kinetic energy of the incoming fluid in one inlet was approximately 3% of the cone volume. This volume was centered on the point defined by the intersection of the cone centerline with the projected centerlines of the two opposing inlets. The fluctuations induced by opposing jet impingement have extremely low energy and are confined to a very small volume region on the cone centerline. Consequently, the flow is well controlled and predictable with very little perturbation in the mean flow patterns predicted from the simulation.

In summary, the CFD simulation results for the inlet cone region of the system described in Example 1 showed that the fluid flow was controlled and predictable. Based on computed flow patterns, the heat transfer from the fluid to the cone surface is expected to be relatively even over the cone surface. By contrast, these flow patterns are distinctly different from those with a single side inlet, wherein a single flow impinges on the cone wall opposing the inlet and leads to very uneven fluid flow and heat transfer in the cone.

The present invention has now been described in relation to particular preferred embodiments. However, many other variations and modifications and other uses may be apparent to those skilled in the art. Accordingly, the present invention should only be limited by the appended claims and not by the specific disclosures herein.

What is claimed is:

1. A fluid dispensing apparatus for use with a delayed coke drum comprising the following components:

(a) a spool that has a wall that encloses an interior space, where the top of the spool is coupled to the bottom of a delayed coke drum and the bottom of the spool is coupled to the top of a coke drum bottom deheader valve;

(b) a main pipe for supplying a primary fluid stream; and (c) a split piping system that comprises an intersection where the primary fluid stream is split into two secondary fluid streams that flow in separate directions along separate legs of branch piping, where each leg of the branch piping (i) includes one or more block valves and (ii) terminates with an equal number of ports;

(d) entry pipes each connected to a port of each leg of the branch piping and to a spool inlet that allows fluid to flow into the interior space enclosed by the spool, each entry pipe being (i) being disposed to direct the fluid to flow into and towards the center of the spool and (ii) angled to dispense fluid into the interior space of the spool at an upward angle not greater than 30 degrees above the horizontal and equal to the upward angle(s) of the other entry pipes(s).

2. The apparatus of claim 1 where each leg of the branch piping is sized so that the secondary fluid streams are substantially equal in flow mass and vapor/liquid proportion.

3. The apparatus of claim 1 where the two legs of branch piping are symmetrical to one another relative to at least one axis.

4. The apparatus of claim 1 where there is one spool inlet per leg of branch piping and the two spool inlets are located approximately 180 degrees apart along an inside surface of the spool wall.

5. The apparatus of claim 1 where there the secondary fluid streams are substantially equal in flow mass and vapor/liquid proportion, where the two legs of branch piping are symmetrical to one another relative to at least one axis, and where there is one spool inlet per leg of branch piping and the two spool inlets are located approximately 180 degrees apart along an inside surface of the spool wall.

6. The apparatus of claim 1 where the split piping system comprises the following components:

(i) two symmetrical branch pipes, each located downstream from the main pipe, each having an inlet port and an outlet port, each equal in diameter to one another but smaller in diameter to the main pipe, and each having a block valve therein, (ii) a main pipe fitting that comprises at least four ports where a first port is an inlet port connected to an outlet port of the main pipe, a second port is an outlet port connected to the inlet port of one branch pipe, a third port is an outlet port connected to the inlet port of the other branch pipe a fourth port is a cleaning port that is removably covered and aligned opposite the first port, (iii) two entry pipes, each located downstream on a different branch pipe and each having an inlet port arid an outlet port, wherein the outlet port of each entry pipe is connected to a spool inlet and (iv) two branch pipe fittings each comprising at least four connection ports where a first port is an inlet port connected to the outlet port of a branch pipe, a second port is an outlet port connected to the inlet port of an entry pipe, a third port is a cleaning port that is removably covered and aligned opposite the first port; and the fourth port is a cleaning port that is removably covered and aligned opposite the second port.

7. The apparatus of claim 1 where each leg of branch piping, or a portion thereof, is angled so that the secondary fluid streams dispense into the interior space of the spool at an angle that is five to twenty degrees above the horizontal.

8. The apparatus of claim 1 including a protective structure which extends above or around each spool inlet and penetrates into the spool interior a distance that, when measured horizontally, is no greater than five percent (5%) of the spool diameter at the same level.

9. The apparatus of claim 1 where the spool additionally contains thermocouples, positioned at various locations around the outside surface of the spool, which feed information to one or more controllers that control the rate at which quench water is added during a coked drum cool down step.

10. A delayed coking unit which comprises a coker furnace for heating coker feed, two or three delayed coke drums, a transfer line for heated effluent from the furnace, a switch valve to direct the heated feed from the transfer line to a particular coker drum, each coke drum having a fluid dispensing device as claimed in claim 1 located at the bottom of the coke drum with the top of the spool of the dispensing device coupled to the bottom of the respective coke drum and the bottom of the spool coupled to the top of a coke drum bottom deheader valve.

11. A fluid dispensing method for delayed coking comprising the following steps:

(a) supplying a spool that has a wall that encloses an interior space at the bottom of a delayed coke drum and where the bottom of the spool is coupled to the top of a coke drum bottom deheader valve;

(b) supplying a primary fluid stream for the delayed coke drum through a main pipe;

(c) routing the primary fluid stream through a split piping system that comprises an intersection where the primary fluid stream is split into two secondary fluid streams that flow in separate directions along separate legs of branch piping, where and where each leg of branch piping terminates with an equal number of ports that are each connected to an entry pipe which is also connected a spool inlet that allows fluid to flow into the interior space enclosed by the spool, each entry pipe being (i) being disposed to direct the fluid to flow into and towards the center of the spool and (ii) angled to dispense fluid into the interior space of the spool at an upward angle not greater than 30 degrees above the horizontal and equal to the upward angle(s) of the other entry pipes(s), and (d) dispensing the secondary fluid streams into the interior space of the spool through the spool inlets.

12. The method of claim 11 where the secondary fluid streams are substantially equal in flow mass and vapor/liquid proportion.

13. The method of claim 11 where there the secondary fluid streams are substantially equal in flow mass and vapor/liquid proportion, where the two legs of branch piping are symmetrical to one another relative to at least one axis, and where there is one spool inlet per each of the two legs of branch piping and the two spool inlets are located approximately 180 degrees apart along an inside surface of the spool wall.

14. The method of claim 11 where, after the coke drum is tilled with coke, each leg of branch piping is purged by opening a cleaning port in a first leg of branch piping while the block valve in the leg is also open, closing the block valves in the other leg of branch piping, purging the first branch leg with water and/or steam and then reopening the closed block valves.

15. The method of claim 11 where the fluid, during a decoking stage of the delayed coking cycle, is steam introduced to control the flow rate of a coke and water mixture exiting the coke drum.

16. The method of claim 11 where each branch leg of branch piping, or a portion thereof, is angled so that the secondary fluid streams dispense into the interior space of the spool at an angle that is five to twenty degrees relative to horizontal.

* * * * *